United States Patent [19]

Mohr, Jr. et al.

[11] 4,345,908

[45] Aug. 24, 1982

[54] STRETCHABLE WOVEN CELLULOSIC FABRIC AND PROCESS FOR MAKING SAME

[75] Inventors: Sigo Mohr, Jr., Hewlett, N.Y.; Jerry L. Carter, Gloverville, S.C.

[73] Assignee: Joshua L. Baily & Co., Inc., New York, N.Y.

[21] Appl. No.: 208,980

[22] Filed: Nov. 21, 1980

Related U.S. Application Data

[63] Continuation-in-part of Ser. No. 98,246, Nov. 28, 1979, abandoned.

[51] Int. Cl.[3] ..... D06M 1/06; D06L 3/02

[52] U.S. Cl. ..... 8/111; 8/125; 8/127

[58] Field of Search ..... 8/125, 127, 111

[56] References Cited

U.S. PATENT DOCUMENTS

| | | | |
|---|---|---|---|
| 2,126,809 | 8/1938 | Pratt | 8/125 |
| 3,287,788 | 11/1966 | Goodbar et al. | 28/76 |
| 3,406,006 | 10/1968 | Lindberg et al. | 8/125 |
| 3,507,609 | 4/1970 | Gorrala | 8/115.7 |
| 3,560,139 | 2/1971 | Suminokura et al. | 8/125 |
| 3,589,030 | 6/1971 | Troope et al. | 68/5 |
| 3,655,327 | 4/1972 | Rollins | 8/130.1 |
| 3,721,097 | 3/1973 | Briley et al. | 62/11 |
| 3,849,067 | 11/1974 | Calamari et al. | 8/115.7 |
| 3,885,587 | 5/1975 | Troope | 137/391 |
| 3,915,632 | 10/1975 | Troope et al. | 8/125 |
| 3,948,490 | 4/1976 | Troope | 8/158 |
| 3,980,429 | 9/1976 | Lawrence et al. | 8/125 |
| 4,074,969 | 2/1978 | Lawrence | 8/125 |
| 4,095,944 | 6/1978 | Duckworth | 8/115.7 |
| 4,099,911 | 7/1978 | Lawrence | 8/125 |
| 4,106,902 | 8/1978 | Aitken et al. | 8/181 |
| 4,152,907 | 5/1979 | Lawrence | 68/5 D |

OTHER PUBLICATIONS

Hall, *Standard Handbook of Textiles*, 8th Ed., John Wiley & Sons, N.Y., 1975, pp. 248–250.

Gogek et al., *Textile Research Journal*, June 1969, pp. 543–547.

Carter, *Essential Fiber Chemistry*, Marcel Dekker Inc., N.Y., 1971, pp. 2–9.

Tortora, *Understanding Textiles*, McGraw Hill, N.Y., pp. 303–307.

Corbman, *Textiles: Fiber to Fabric*, McGraw Hill, N.Y., 1975, pp. 175–187.

*Primary Examiner*—Maria Parrish Tungol

*Attorney, Agent, or Firm*—Pennie & Edmonds

[57] ABSTRACT

A woven, predominantly cellulosic fabric, such as an open-weave cotton-based fabric, having at least about 11 percent stretchability in the weft direction with less than about 6 percent growth (after repeated wash-dry cycles) and having wrinkle resistance and shrinkage control within commercial tolerances, is produced by first subjecting a woven, predominantly cellulosic fabric precursor to warp-wise tension while maintaining the fabric in a relaxed state in the filling direction. Next, the fabric is contacted with aqueous alkali while maintaining the aforesaid warp-wise tension, after which the thus-mercerized fabric is subjected to a tensile force in the filling direction sufficient to impart to the fabric, while said force is being applied and while maintaining warp-wise tension, a width of within about −1 and +3 percent of the initial greige width. The fabric is then washed with water to substantially remove the aqueous alkali while maintaining warp-wise tension. The fabric is next contacted with anhydrous liquid ammonia under warp-wise tension and then subjected to compressive shrinkage.

9 Claims, 1 Drawing Figure

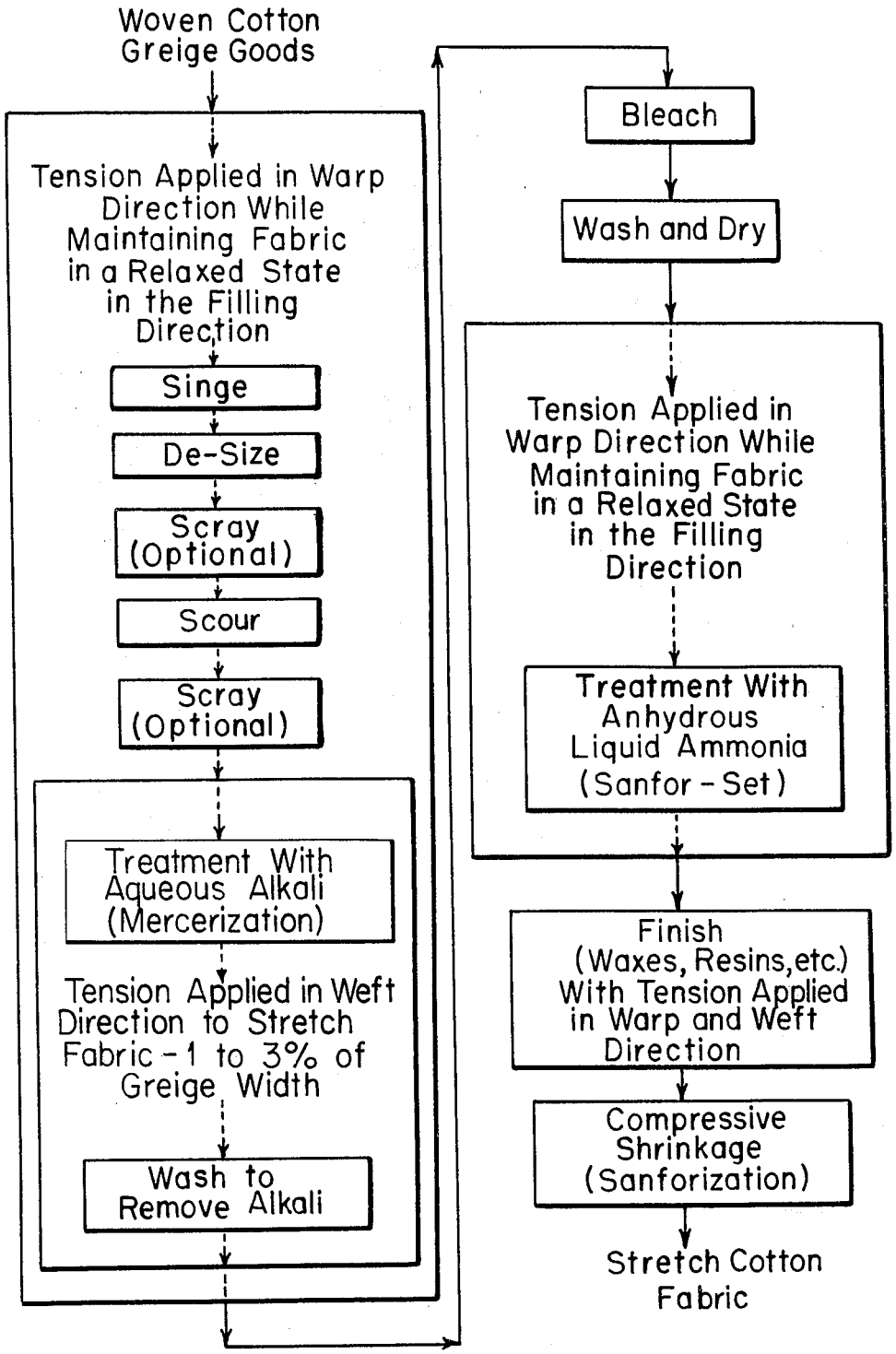
Woven Cotton Greige Goods
Tension Applied in Warp Direction While Maintaining Fabric in a Relaxed State in the Filling Direction
Singe
De-Size
Scray (Optional)
Scour
Scray (Optional)
Treatment With Aqueous Alkali (Mercerization)
Tension Applied in Weft Direction to Stretch Fabric - 1 to 3% of Greige Width
Wash to Remove Alkali
Bleach
Wash and Dry
Tension Applied in Warp Direction While Maintaining Fabric in a Relaxed State in the Filling Direction
Treatment With Anhydrous Liquid Ammonia (Sanfor - Set)
Finish (Waxes, Resins, etc.) With Tension Applied in Warp and Weft Direction
Compressive Shrinkage (Sanforization)
Stretch Cotton Fabric

STRETCHABLE WOVEN CELLULOSIC FABRIC AND PROCESS FOR MAKING SAME

CROSS-REFERENCE TO RELATED APPLICATION

This is a continuation-in-part of application Ser. No. 098,246, filed Nov. 28, 1979 now abandoned.

DESCRIPTION

1. Technical Field

This invention relates to the treatment of textile fabrics composed of cellulosic materials and to products obtained thereby having a novel combination of recoverable stretch, shrinkage control, wrinkle resistance and durability of these characteristics through repeated home launderings.

More particularly, the invention has to do with novel, predominantly cellulosic woven fabrics, such as cotton-based fabrics, characterized by a high degree of stretchability in the weft or filling direction with accompanying high recovery and low growth, even after repeated home laundering and tumble dry cycles.

2. Background Art

In order to maintain and expand the important position of cellulosic fabrics (e.g., rayon- and cotton-based fabrics) in the textile marketplace in the face of increasing competition from synthetic fibers such as those derived from petrochemicals, considerable research has been conducted in recent years to increase the versatility of textile fabrics made from cellulosic fibers.

Conventional woven (as opposed to non-woven, e.g., knitted) cellulosic fabrics, composed of warp and weft (filling) yarns, and particularly woven cotton-based fabrics, normally lack the desirable ability to stretch recovery and with low growth after repeated home laundering and tumble dry cycles. Stretchable woven fabrics devoid of rubber or other elastomeric fibrous material have recently become increasingly desirable in the trade. Accordingly, intensive efforts have been directed at discovering a method for imparting a high degree of stretch to woven cellulosic fabrics such as those composed of 100 percent cotton or blends of polyester staple and cotton. Such fabrics would be highly desirable in order to take advantage of the known special properties of cotton and of polyester/-cellulosic blends, such as wash-and-wear qualities, wrinkle resistance, strength and good textile aesthetics.

Previous attempts to make cotton or cotton blend stretch fabrics by the chemical methods of the prior art have been unsatisfactory. For example, cotton fabrics treated by the process of slack-mercerization, which provides only a low degree of stretch for a given fabric construction, do not recover well from the stretched condition, and thus have a tendency to "grow", nor do they have wrinkle-resistance qualities. In order to improve the recovery property of cotton-containing fabrics, it is usually necessary to use a thermosetting resin in order to "fix" the shrunk fabric so that it has a better tendency to retract from stretching. However, such resin treatment usually causes serious degradation of fabric strength and is non-permanent. In the case of blended-yarn fabrics, a stepwise shrinkage method of imparting stretch, in which first one of the fiber components of the yarn is treated and allowed to shrink and then the other fiber component is treated and allowed to shrink, has also been found unsatisfactory, because the resulting fabrics possess a relatively low ability to stretch.

A need has therefore existed for improved woven cellulosic stretch fabrics, particularly those which will stretch in one direction (e.g., the weftwise or filling direction) and remain relatively inelastic in the perpendicular direction (e.g., the warpwise direction), while at the same time having a high degree of stretch recovery, wrinkle resistance and shrinkage control, even after repeated wash-and-dry cycles. Such fabrics would be especially useful for clothing, upholstery and the like wherein the fabric is intended to fit more or less tightly over an irregular surface without developing undesirable "creep" or bagginess.

Accordingly, it is an object of the present invention to provide woven cellulosic fabrics, such as a cotton-based woven fabric, having a high degree of recoverable stretch in at least one direction across the fabric, such as in the direction of the filling elements.

Another object is to provide a process for producing woven cellulosic fabrics, such as a cotton-based woven fabric, having a high degree of recoverable stretch in at least one direction across the fabric, such as in the direction of the filling elements.

These and other objects of the invention, as well as a fuller understanding of the utility and advantages thereof can be had by reference to the following disclosure and claims.

DISCLOSURE OF THE INVENTION

The foregoing objects are achieved according to the present invention which provides a fabric woven from cellulosic fibers and treated in such a way as to produce a high degree of low growth, recoverable stretchability in one direction while retaining normal non-stretch characteristics in the other direction together with shrinkage control within commercial tolerances ranging from plus or minus 1 to 3 percent.

More particularly, the invention comprises a woven, predominantly cellulosic fabric having at least about 11 percent, desirably at least 12 percent, and preferably 13 to 20 percent stretchability (with at least about 94 percent recovery) in the width-wise or filling direction, with less than about 6 percent and preferably less than about 5 percent growth after repeated wash-and-wear cycles, and preferably after at least about 3 such cycles. Predominantly cellulosic fabrics include fabrics derived from yarns composed of substantial amounts of, and preferably at least about 50 percent natural or regenerated cellulosic materials, e.g., cotton, flax and rayon. Other constituents of the fabric can include polyester, polyamide, wool, and the like. Desirably, the fabric is a cotton-based fabric, with fabric composed of 100 percent cotton being especially preferred. The fabric desirably has an openweave construction and can be a plain-weave, twill, cord or any other type of weave pattern produced on a loom. Desirably, the fabric is of a plain-weave or twill construction of less than about 68×46 using a coarser than about 16 cotton count yarn, and preferably less than about 60×46 using a coarser than about 13 cotton count yarn.

The present fabric is produced according to the invention by a method which comprises subjecting a woven, predominantly cellulosic fabric precursor (greige goods) to a tensile force in the warp-wise direction sufficient to produce tautness while maintaining the fabric in a relaxed state in the filling direction, during which time the cloth can be singed, desized and scoured. With or without relaxation of the warp tension, the fabric is given a mercerization treatment by contacting it with caustic or aqueous alkali, preferably using aqueous sodium hydroxide at a temperature of between about 25° and 55° C. and a concentration of between about 40 and 55° Tw (the units Tw or "Twaddle" being herein defined as 200× [(specific gravity at 15° C.)−1]). It is then subjected to a tensile force in the filling direction sufficient to thereby impart to the fabric a width which is within about −1 to +3 percent of the initial greige width, while maintaining warp-wise tension. Next, without relaxation of the warp tension, the fabric is washed with water to remove substantially all, and preferably at least to the extent of about 90 percent, of the aqueous alkali. The fabric is then contacted with anhyrous liquid ammonia, preferably at −33° C. or below while maintaining warp-wise tension. Next, the fabric may be treated with waxes, oils, resins, etc. while maintaining warp-wise and weft-wise tension. As the final step the fabric is subjected to compressive shrinkage under conditions known to those skilled in the art as "Sanforizing." With respect to the aforementioned treatment with liquid ammonia, the basic conditions and apparatus are those of the "Sanfor-Set" technique developed by Cluett Peabody & Co., Inc. and disclosed in U.S. Pat. Nos. 3,406,006; 3,589,030; 3,948,490; 3,721,097; 3,915,632; 3,980,429; 4,074,969; 4,099,911; and 4,152,907.

The physical and chemical mechanisms of the foregoing process of the invention are not fully understood. However, without wishing to be bound by theory, it is believed that such mechanisms in some way involve the minimization of potential energy in the fabric whereby the warp yarns or elements become straightened (i.e., the crimp initially imparted thereto during the weaving process is reduced) at the expense of increased, enduring crimp in the filling yarns or elements so that the aforesaid desirable elastic properties are obtained. The resulting permanent exchange of crimp between the warp and filling yarns affords a product exhibiting a low resistance to deformation (which is an important consideration in designing garments), while at the same time exhibiting excellent recovery from deformation and very low permanent "set" (an important parameter for shape retention of garments, especially for snug-fitting garments) as well as a high degree of wrinkle resistance and shrinkage control, even after repeated wash-and-dry cycles.

BRIEF DESCRIPTION OF THE DRAWING

Further details of the invention and its preferred embodiments can be had by reference to the accompanying drawing, which is a flow sheet of the method for producing the present product as illustrated in detail by the following example.

BEST MODE FOR CARRYING OUT THE INVENTION

Seven samples of woven greige goods having the following constructions are each sequentially singed, desized, scoured, mercerized, partially washed, squeezed and wound up wet in a continuous process as described in detail hereinbelow.

Sample 1 (100% cotton) is a 58 inch wide 48×44 1.40 sheeting (regular twist), warp 12/1, filling 10/1.

Sample 2 (100% cotton) is a 51½ inch wide 40×30 1.27 soft filled sheeting, warp 9/1, filling 4.25/1 (soft twisted).

Sample 3 (100% cotton) is a 57½ inch wide 58×42 1.35 2×1 left hand twill, warp 12/1, filling 10/1.

Sample 4 (100% cotton) is a 58 inch wide 40×44 1.73 sheeting.

Sample 5 (100% cotton) is a 51½ inch wide 52×30 1.11 2×1 right hand twill.

Sample 6 (100% cotton) is a 57½ inch wide 58×42 1.35 2×1 right hand twill.

Sample 7 (97% cotton/40% wool: 100% cotton warp×90% cotton/10% wool filling) is a 63 inch wide 48×38 1.37 2×1 right hand twill.

During the process, singeing, desizing and scouring (with weak caustic), with optional scrays before and/or after scouring, are performed at open width with no weftwise tension, but with tension continuously applied in the warp direction, except in the scrays, such tension being sufficient to maintain tautness. Following scouring, aqueous sodium hydroxide at 52° Tw is applied at about 40° C. to mercerize the open width goods in a pad. Immediately after the pad, the goods are gripped by a long tenter frame which widens gradually over its length so that the fabric exits from the frame at within −1% to +3% of initial greige width, which thereby influences the final width of the finished fabric. In this way, Samples 1 and 3 as mercerized at greige width and Sample 2 is mercerized at 1 inch wider than greige width. Several water washings while the goods are still in the tenter frame and in a wash box after the tenter frame remove approximately 90% of the caustic. Following a squeeze cycle to remove excess moisture, the goods are wound up wet on a large-diameter roll. Warp tension is maintained as the goods are being tightly wound up on the roll.

The wet roll is transported in an A-frame to a bleaching range wherein the fabric is processed in open width with no weftwise tension throughout the entire bleaching process. The partially washed fabric from the wet roll is washed in about three wash boxes, then bleached with peroxide, provided with a dwell time of about one hour in a J-box or up to about 10 minutes in a steamer. Up to 7,000 yards of cloth can be accumulated during the dwell period with the fabric feeding in the front and out the back. During the dwell period in a J-box or conveyor, there is no warp-wise or weft-wise tension. Next, the fabric is passed through about four additional wash boxes to remove the bleach, following which the fabric passes over dry cans and is wound up on a roll dry. This is the second break in the process.

Following bleaching, in most cases except when the goods are to be bleached white or naphthol dyed, they are dyed on a dye range to the desired color and rolled up. Next, they are processed in a "Sanfor-Set" machine which subjects the open width fabric to liquid anhydrous ammonia at about −33° C. There is no weftwise tension or width control during the "Sanfor-Set" process, but warp tension, which indirectly controls the width, should be applied and maintained during this stage of the process. The "Sanfor-Set" machine includes a large closed box containing a multiplicity of rolls including about three large Palmer rolls, each of which is preceded by an adjustable tension roll. The open width fabric emerges from the "Sanfor-Set" machine and is wound up dry. This is the third break in the process except for dyed goods, for which it would be the fourth break. At this point, the width of the fabric should be substantially less than the initial greige width.

Following the "Sanfor-Set" step, if goods are to be naphthol dyed, they are then processed with such dye;

if the goods are to be bleached white, they are re-bleached. In both cases they are then wound up dry on a roll.

The next step is to process the open width fabric on a finishing range equipped with a tenter frame which adjusts the width for a preferred combination of shrinkage tolerance and stretch and recovery properties. Waxes, resins and oils are applied to give the finished fabric the desired properties and hand. The goods are again wound up dry or with some residual moisture.

In the final step, the goods are Sanforized in a conventional manner, i.e., processed on a compressive shrinkage machine. This machine can be equipped with a tenterette or short tenter frame to prevent excessive loss of width while the fabric is moistened with water before being pre-shrunk by the blanket and Palmer cylinder. The fabric emerges from the compressive shrinkage machine and is wound up dry on a roll in final finished form, ready for inspection, packaging and shipment.

Typical observed widths during processing are as follows:

| | Sample 1 | Sample 2 | Sample 3 | Sample 4 | Sample 5 | Sample 6 | Sample 7 |
|---|---|---|---|---|---|---|---|
| Greige Width | 58" | 51½" | 57½" | 58" | 51½" | 57½" | 63" |
| After desizing/scouring | 48½" | 44½" | 47" | — | 46½" | 47" | 50" |
| After mercerizing pad | 48½" | 44½" | 47" | — | 51½" | 47" | 50" |
| At exit of tenter frame | 58" | 52½" | 57½" | — | 57½" | 57½" | — |
| Wet roll after merc. | 49¼" | 45½" | 48" | — | 47¾" | 48" | 51" |
| Dry roll after bleach | 48½" | 44¼" | 47" | — | 46½" | 47" | 50¼" |
| Dry roll after dye range | 48" | 41½" | — | — | 45½" | — | 46¾" |
| Dry roll after "Sanfor-Set" | 48½" | 42" | — | — | 45¼" | 49½" | 48" |
| Dry roll after finishing range | 48¾" | 44¾" | — | — | 44¾" | — | — |
| Dry roll after compressive-shrinkage | 48¼" | 44¼" | 50¼" | 49⅜" | 44½" | 50¼" | 50" |
| Stretch (%)* | 16.1 | 13.4 | 13.6 | 14.9 | 12.0 | 13.6 | 16.8 |
| Growth (%)* | 5.1 | 4.5 | 4.2 | 3.3 | 2.4 | 4.2 | 5.4 |

*Based on average measurements of 30 minutes recovery vs. stretch after three home laundering and tumble dry cycles.

The foregoing description and example are presented for the purpose of illustrating the invention and its utility and advantages without intending to limit same in any way to specific features or embodiments. It is understood that changes and variations can be made in the product and process of the invention without departing from the scope thereof as defined in the following claims.

Having thus described our invention, what we claim as new and desire to secure by Letters Patent is:

1. In a woven, predominantly cellulosic fabric, the improvement wherein the fabric has at least about 11 percent stretchability in the filling direction with less than about 6 percent growth over repeated washing and drying cycles and having wrinkle-resistance and shrinkage control within commercial tolerances, said improvement being obtained by the method comprising:

(a) subjecting a woven, predominantly cellulosic fabric precursor to warp-wise tension while maintaining the fabric in a relaxed state in the filling direction;

(b) mercerizing the fabric by contacting it with aqueous alkali, while maintaining the condition of step (a);

(c) subjecting the fabric treated in step (b) to a tensile force in the filling direction sufficient to impart to the fabric, while said force is being applied and while maintaining the warp-wise tension of step (a), a width of within about −1 and +3% of the initial greige width;

(d) washing the fabric treated in step (c) to substantially remove the aqueous alkali therefrom while maintaining the conditions of step (a);

(e) contacting the fabric obtained in step (d) with anhydrous liquid ammonia under the conditions or step (a) whereby the width of the emerging fabric is substantially less than the inital greige width; and (f) subjecting the fabric obtained in step (e) to compressive shrinkage.

2. The improvement according to claim 1 wherein the fabric precursor is an open weave fabric.

3. The improvement according to claim 1 wherein the fabric precursor is a cotton-based fabric.

4. The improvement according to claim 3 wherein the fabric precursor is a 100 percent cotton fabric.

5. The improvement according to claim 1 wherein the fabric is an open weave, cotton-based fabric.

6. The improvement according to claim 5 wherein the fabric precursor is a 100 percent cotton fabric.

7. The improvement according to claim 1, 2, 3, 5, 4, or 6 wherein:

the fabric precursor in step (a) is singed, desized and scoured prior to step (b);

step (b) is carried out at between about 25° and 55° C. using aqueous sodium hydroxide at between about 40 and 55° Tw;

the condition of step (c) is maintained during at least a portion of step (d);

the fabric treated in step (d) is squeezed to remove excess moisture and wound up wet on a roll while maintaining the condition of step (a);

step (e) is carried out using liquid ammonia at a temperature of about −33° C.; and step (f) is carried out using a tenterette to substantially maintain the width of the fabric while said fabric is contacted with $H_2O$ before being pre-shrunk by a blanket and Palmer cylinder.

8. The improvement according to claim 7 wherein prior to step (e), the fabric is washed in open width with no weft-wise tension and then dried.

9. The improvement according to claim 7 wherein prior to step (e), the fabric is bleached in open width with no weft-wise tension and then washed to remove the bleach and dried.

* * * * *

UNITED STATES PATENT AND TRADEMARK OFFICE

CERTIFICATE OF CORRECTION

PATENT NO. : 4,345,908

DATED : August 24, 1982

INVENTOR(S) : Sigo Mohr, Jr. and Jerry L. Carter

It is certified that error appears in the above-identified patent and that said Letters Patent are hereby corrected as shown below:

Colum 1, line 58, "property of cotton-containing" should be -- property of cotton or cotton-containing--.

Colum 4, line 25, "1 and 3 as" should be --1 and 3 are--

Colum 6, line 8, "or" should be --of--.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*